United States Patent [19]

Aronson

[11] 4,244,660

[45] Jan. 13, 1981

[54] CONTAINING MARKERS IN INTERLEAVED RELATIONSHIP

[76] Inventor: George L. Aronson, 500 Governor's Dr., Winthrop, Mass. 02152

[21] Appl. No.: 52,542

[22] Filed: Jun. 27, 1979

[51] Int. Cl.[3] ..... B42D 3/12; B65D 85/28

[52] U.S. Cl. ..... 402/79; 206/443; 281/31; 281/32; 281/45; 402/500

[58] Field of Search ..... 281/1, 3 R, 4, 17, 19 R, 281/30, 31, 32, 45; 402/500, 79; 206/214, 443, 479, 480, 481; 211/69.1; D22/13, 14; 224/203, 223, 224, 225; D19/27, 33

[56] References Cited

U.S. PATENT DOCUMENTS

| | | | |
|---|---|---|---|
| D. 193,926 | 10/1962 | Wicker et al. | D22/14 |
| 803,464 | 10/1905 | Beck | 281/30 |
| 2,088,953 | 8/1937 | Greer | 281/31 |
| 2,194,003 | 3/1940 | Brooks | 281/1 |
| 2,477,806 | 8/1949 | Isaacson | 224/225 |
| 2,648,366 | 8/1953 | Higbee et al. | 281/31 X |
| 2,682,981 | 6/1954 | Previdi | 224/223 |
| 3,126,891 | 3/1964 | Caputi | 206/443 X |

FOREIGN PATENT DOCUMENTS

| | | | |
|---|---|---|---|
| 2359041 | 5/1975 | Fed. Rep. of Germany | 206/443 |
| 752826 | 3/1933 | France | 206/479 |
| 643124 | 9/1950 | United Kingdom | 402/500 |

*Primary Examiner*—Paul A. Bell
*Assistant Examiner*—John S. Brown
*Attorney, Agent, or Firm*—Charles Hieken

[57] ABSTRACT

A container for marking instruments comprises a support strip having a plurality of pockets attached to a carrier so as to interact with other pockets on another support strip for the purpose of securing the marking instruments neatly in place when not in use.

11 Claims, 2 Drawing Figures

CONTAINING MARKERS IN INTERLEAVED RELATIONSHIP

BACKGROUND OF THE INVENTION

The present invention relates in general to containers for marking instruments and more particularly to containers adapted to be assembled in a binder or between covers.

Usually a plurality of crayons, pencils, artists' paintbrushes and the like are deposited together in a container such as a simple box. It is sometimes desirable to arrange the container so that the marking devices can be kept separate and neatly in place in an organized manner, such as by size or color. It is also desirable to arrange the container so that it might serve another purpose other than holding the markers.

Accordingly, it is an important object of this invention to provide an improved container or holder for marking instruments.

It is a further object of the invention to achieve the preceeding object with a holder that may be detachably secured to a binder.

SUMMARY OF THE INVENTION

A marking instrument container comprises a first strip of material having first and second pockets with sides formed from flexible material and a third pocket provided between the sides, and carrier means for mounting the strips thereon. Numerous other features, objects and advantages of the invention will become apparent from the following specification when read in connection with the accompanying drawing in which:

DETAILED DESCRIPTION OF PREFERRED EMBODIMENTS

Figure 1:
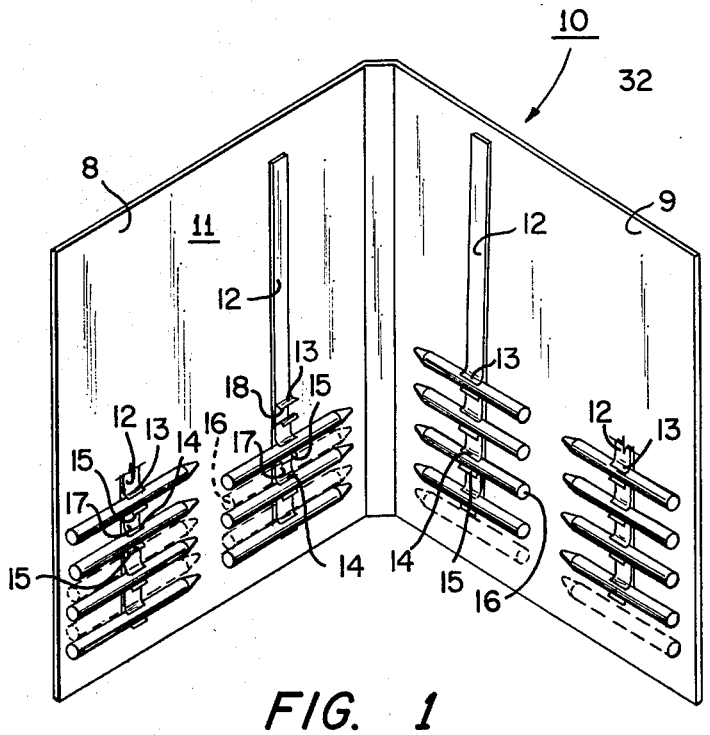
FIG. 1 is an isometric view of one embodiment of a container for marking instruments arranged according to the invention.

Referring to FIG. 1, there is shown a container 10 for crayons, pencils, pens or other marking devices comprising a cover 11 or carrier adapted to be folded in half and one or more marking device retainers 12 attached to opposing halves 8,9 of the cover 11. The retainers 12 are narrow strips of supporting material having a plurality of interrupted semicircular, open-end, clips 13 formed from spring-like material, such as plastic. The clips 13 extend from the retainers 12 so as to provide a plurality of adjacent fingers 14, 15 curved in opposite directions with a pocket 18 therebetween. Retaining wells 16 or pockets are formed between adjacent fingers 14, 15 of adjacent clips 13.

The retainers 12 are attached to opposing halves 8, 9 of the cover 11 so that the edges of adjacent fingers 14, 15 of the clips 13 holding a marking instrument 15 on one cover half 9 are loosely received in the space 17 between opposing edges 14, 15 of adjacent clips 13 on an opposite cover half 8.

The clip fingers 14, 15 are separated by a predetermined distance, D1, selected to tightly retain or hold a marking instrument 16 inserted into the pocket 18. The marking instrument 16 is pushed against the curved sides of the fingers 14, 15, forcing them apart, until the instrument settles in the pocket 18. For example, the distance D1 is $\approx \frac{1}{4}$ to hold a 5/16" diameter crayon. The fingers 14, 15 return to their original position when the marking instrument 16 is removed from the pocket 18.

Figure 2:
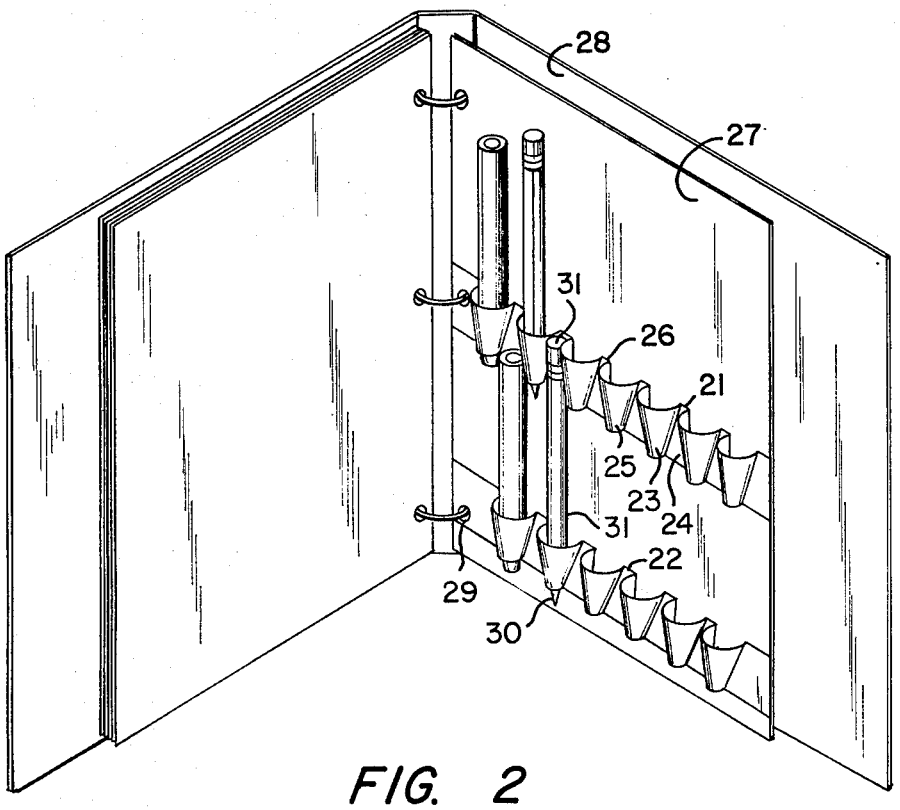
FIG. 2 is an isometric view of another embodiment of a container for marking instruments arranged according to the invention.

Referring to FIG. 2, there is shown another embodiment of a container 20 for marking instruments comprising first and second 22 strips of material each formed with a plurality of truncated, semiconical, open-ended pockets 23 or wells alternating with flat truncated isosceles triangular sections 24. The truncated ends 25 of the pockets 23 and the truncated ends 26 of the triangular sections 24 are on opposite sides of the strips 21, 22. The containers 20 are glued or otherwise attached to a suitable carrier, such as a notebook page 27 of a ring type binder 28. In the preferred embodiment, the strips 21, 22 are attached to the notebook page 27 one above the other so that the longitudinal axis of the pockets 23, of a first strip 21 are substantially coaxial with the perpendicular bisector of the base of the triangular section 26 of the second strip 22. In addition, the strips 21, 22 are located on the notebook page 27 so as to reinforce a punched hole 29 on the page 27 to help prevent the page 27 from being ripped from the binder 28. The pockets 23 are dimensioned to receive and hold the marking nib 30 of a marking instrument 31, such as a pencil, while the triangular section 24 is dimensioned to receive and hold an opposite of the marking instrument, such as the eraser 31 between adjacent sides of adjacent pockets 23. Thus, the marking nib 30 of the pencil is held in the pocket 23 on the second strip 22 while the eraser 31 is held in the triangular section 24 between adjacent pockets 23 on the first strip 21.

The invention has a number of advantages. It accommodates markers of different lengths and different diameters while protecting them from breakage and abrasion. It provides individual readily accessible ordered storage locations for markers that are firmly secured yet easily removed for use. It provides secure support despite the orientation of the container. It provides a convenient means for organizing markers to make them readily available and help avoid misplaced and lost markers. It can be made in different sizes and of different materials.

The invention may also be used on the notebook cover, preferably on the inside. The invention also may be used on multiple pages with structure on one or both sides of a sheet for supporting markers according to the invention.

There has been described novel apparatus and techniques facilitating the holding of marking instruments in a convenient and organized manner. It is evident that those skilled in the art may now make numerous uses and modifications of and departures from the specific apparatus and techniques herein disclosed without departing from the inventive concepts. Co sequently, the invention is to be construed as embracing each and every novel feature and novel combination of features present in or possessed by the apparatus and techniques herein disclosed and limited solely by the spirit and scope of the appended claims.

What is claimed is:

1. A marking instrument container comprising, first and second strips of supporting material each having first and second pockets with sides formed from flexible material and a third pocket provided between said sides, and carrier means comprising opposed first and second sheets affixed so that they may be opened apart and closed together for mounting said strips thereon, said first and second strips being attached to said first and second sheets respectively so that said first pocket on said first strip is received in said third pocket on said second strip when said sheets are closed together.

2. A marking instrument container in accordance with claim 1, wherein said first and second pockets include first and second interrupted semicircular open-ended clips extending from said strips to provide fingers curved in opposite directions.

3. A marking instrument container in accordance with claim 2, wherein said third pocket is formed between adjacent fingers of said first and second clips.

4. A marking instrument container in accordance with claim 1, wherein said carrier means is a cover adapted to be folded in half to form said first and second sheets.

5. A marking instrument container comprising, first and second strips of supporting material each having first and second spaced pockets with sides formed from flexible material and a third pocket provided between said sides, carrier means comprising a sheet for mounting said strips thereon, said first strip being mounted upon said sheet below said second strip so that the longitudinal axes of the first and second pockets of each of said strips pass through a third pocket of the other of said strips so that a portion of a marker stored in a first or second pocket of one of said strips may reside between portions of markers stored in first and second pockets of the other of said strips.

6. A marking instrument container in accordance with claim 5, wherein said first and second pockets include first and second truncated semiconical pockets.

7. A marking instrument container in accordance with claim 6, wherein said third pocket is a flat truncated triangular section formed between said adjacent sides of said first and second truncated semiconical pockets.

8. A marking instrument container in accordance with claim 5, wherein said carrier means is a notebook page having a plurality of punched holes and removably attachable to a ring type binder.

9. A marking instrument container in accordance with claim 8, wherein said first strip is attached to said notebook page to provide support for at least one of said punched holes and said second strip is attached to said notebook page to provide support for another of said punched holes.

10. A marking instrument container in accordance with claim 9, wherein said first strip is mounted upon said notebook page below said second strip so that the longitudinal axis of said first and second semiconical pockets of said first strip are coaxial with the perpendicular bisector of the base of said triangular sections of said second strip.

11. A marking instrument container in accordance with claim 1, wherein said carrier means comprises a portion of a notebook.

* * * * *